US007343292B2

(12) United States Patent
Takamizawa et al.

(10) Patent No.: US 7,343,292 B2
(45) Date of Patent: Mar. 11, 2008

(54) AUDIO ENCODER UTILIZING BANDWIDTH-LIMITING PROCESSING BASED ON CODE AMOUNT CHARACTERISTICS

(75) Inventors: Yuichiro Takamizawa, Tokyo (JP); Toshiyuki Nomura, Tokyo (JP)

(73) Assignee: NEC Corporation, Tokyo (JP)

( * ) Notice: Subject to any disclaimer, the term of this patent is extended or adjusted under 35 U.S.C. 154(b) by 820 days.

(21) Appl. No.: 10/399,101

(22) PCT Filed: Oct. 11, 2001

(86) PCT No.: PCT/JP01/08920

§ 371 (c)(1),
(2), (4) Date: Apr. 14, 2003

(87) PCT Pub. No.: WO02/33831

PCT Pub. Date: Apr. 25, 2002

(65) Prior Publication Data

US 2004/0049378 A1 Mar. 11, 2004

(30) Foreign Application Priority Data

Oct. 19, 2000 (JP) ..... 2000-319699

(51) Int. Cl.
*G10L 19/00* (2006.01)
*G10L 21/00* (2006.01)

(52) U.S. Cl. ..... 704/501; 704/222

(58) Field of Classification Search ..... 704/501
See application file for complete search history.

(56) References Cited

U.S. PATENT DOCUMENTS 3,341,659 A * 9/1967 Stern ..... 380/40

(Continued)

FOREIGN PATENT DOCUMENTS

JP 62-66358 4/1987

(Continued)

OTHER PUBLICATIONS

Sinha et al., 'Low Bit Rate Transparent Audio Compression using Adapted Wavelets' IEEE Transactions of Signal Processing, vol. 41, No. 12, Dec. '1993. pp. 3463-3479.*

(Continued)

*Primary Examiner*—David Hudspeth
*Assistant Examiner*—Justin W. Rider
(74) *Attorney, Agent, or Firm*—Scully, Scott, Murphy & Presser PC

(57) ABSTRACT

A mapping transform unit subjects input audio signals to a mapping transform and generates frequency region signals that take frequency as a variable; a code amount designation unit supplies a preset coding bit rate as a code amount output; a frequency region signal compression encoder, based on the code amount, subjects input frequency region signals to a compression encoding process and generates a bitstream; and a bandwidth-limiting unit executes a bandwidth-limiting processing in which a part of the frequency zone covered by frequency region signals is allotted to an attenuation frequency zone, and in which the value of the frequency region signal is multiplied by an attenuation coefficient having a value less than 1 in the attenuation frequency zone to attenuate the frequency region signal in the attenuation frequency zone, and supplies the frequency region signals that have undergone the bandwidth-limiting processing to the frequency region signal compression encoder.

20 Claims, 9 Drawing Sheets

U.S. PATENT DOCUMENTS

| | | | | |
|---|---|---|---|---|
| 4,588,979 | A * | 5/1986 | Adams | 341/131 |
| 4,969,192 | A * | 11/1990 | Chen et al. | 704/222 |

FOREIGN PATENT DOCUMENTS

| | | |
|---|---|---|
| JP | 62-274809 | 11/1987 |
| JP | 4-104617 | 4/1992 |
| JP | 4-504192 | 7/1992 |
| JP | 04-313964 | 11/1992 |
| JP | 05-260100 | 10/1993 |
| JP | 08-125543 | 5/1996 |
| JP | 08-237130 | 9/1996 |
| JP | 09-187005 | 7/1997 |

OTHER PUBLICATIONS

"*Digital Audio Compression Standard* (*AC-3*", Advanced Television Systems Committee, James C. McKinney, et al., Dec. 20, 1995, 6 pages.

* cited by examiner

AUDIO ENCODER UTILIZING BANDWIDTH-LIMITING PROCESSING BASED ON CODE AMOUNT CHARACTERISTICS

BACKGROUND OF THE INVENTION

The present invention relates to an audio signal encoder, and more particularly to an audio signal encoder that includes: a mapping transform unit for subjecting input audio signals to mapping transform to generate frequency region signals that vary in response to frequency variation (also referred to as frequency domain signals, which are expressed as a function defined with respect to a frequency domain); a code amount designation unit that supplies, as a code amount, a coding bit rate set or designated by a user; and a frequency region signal compression encoder that, based on the code amount designated by the code amount designation unit, subjects frequency region signals to compression encoding processing to generate a bitstream.

One example of an audio signal encoder of the prior art is described in Digital Audio Compression Standard AC-3 issued by the Advanced Television System Committee (referred to hereinbelow as Reference 1). FIG. 1 is a block diagram of the audio signal encoder described in Reference 1. The audio signal encoder of the prior art shown in FIG. 1 is provided with: bandwidth-limiting filter 20, mapping transform unit 11, code amount designation unit 12, and frequency region signal compression encoder 13.

Bandwidth-limiting filter 20 eliminates a frequency component that is not the object intended to encode from the input audio signals. Mapping transform unit 11 executes a mapping transform process on the input bandwidth-limited audio signals to generate frequency region signals. Code amount designation unit 12 transfers a coding bit rate that has been designated by the user to frequency region signal compression encoder 13. Based on the coding bit rate supplied by code amount designation unit 12, frequency region signal compression encoder 13 executes compression-coding processing on the frequency region signals to generate a bitstream.

In the above-described audio signal encoder of the prior art, the frequency components, which are included in the input audio signals but are not intended to encode, are removed through bandwidth-limiting filter processing in bandwidth-limiting filter 20. As an example, the use of a 3-Hz high-pass filter is recommended in the section on Input Filtering in Chapter 8.2. 1.3 of the above-described Reference 1.

However, this bandwidth-limiting filtering typically requires a large number of product-sum operations, and thus has the problem of entailing a large amount of operations.

The bandwidth-limited audio signals are subject to a mapping transform in mapping transform unit 11 and converted to frequency region signals. In Reference 1, a Modified Discrete Cosine Transform (MDCT) is used as the mapping transform to generate MDCT coefficients. The MDCT coefficients are frequency region signals that specify the behavior of the input audio signals through the use of frequency as a variable. The Modified Discrete Cosine Transform is widely used as a mapping transform means in audio encoding, and since the details regarding such aspects as calculation formulas of this means are widely known from documents such as Reference 1, explanation is here omitted. In Reference 1, a single Modified Discrete Cosine Transform normally generates 256 MDCT coefficients.

The MDCT coefficient represents spectrum intensity of an input audio signal with respect to frequency.

Code amount designation unit 12 supplies a coding bit rate that has been predetermined or that has been designated by a user to frequency region signal compression encoder 13.

Frequency region signal compression encoder 13 subjects the MDCT coefficients that have been generated by mapping transform unit 11 to information compression so as to meet the coding bit rate designated by code amount designation unit 12 and generates a bitstream. The information compression in this case includes entropy coding of quantized values, suppression of signal redundancy among a plurality of channels, and quantization based on auditory characteristics that are generally widely used in audio encoding. These techniques are generally widely known from documents such as Reference 1, and because these techniques have no relation to the novelty of the present invention, explanation regarding the details of these techniques is here omitted.

As previously described, the problem of the audio signal encoder of the above-described prior art is a large number of product-sum operations required for the filter processing of the bandwidth-limiting filter to result in a large amount of operations of the bandwidth-limiting filter.

It is an object of the present invention to eliminate the signals of a frequency zone which are not the object of coding by means of a small amount of operations and thereby improve the performance of an audio signal encoder, and further, to increase the speed of the encoding process, reduce power consumption, improve integration, and finally, simplify the circuits and the device construction.

SUMMARY OF THE INVENTION

To achieve the above-described object, the audio signal encoder of the present invention includes a bandwidth-limiting unit for executing bandwidth-limiting processing in accordance with attenuation characteristics that have been set corresponding to the code amount designated by said code amount designation unit. The bandwidth-limiting processing includes steps of allocating a part of the frequency zone covered by the frequency region signals to an attenuation frequency zone, and multiplying the values of frequency region signals in the attenuation frequency zone by attenuation coefficients each having a value less than 1 to attenuate the frequency region signals in the attenuation frequency zone; and supplying frequency region signals that have undergone the bandwidth-limiting processing to the frequency region signal compression encoder.

As one embodiment of the bandwidth-limiting unit, the bandwidth-limiting unit executes a bandwidth-limiting processing of: attenuating the frequency region signal in an attenuation frequency zone by multiplying the frequency region signal by an attenuation coefficient defined so as to vary or monotonouly decrease as the frequency varies from an attenuation start frequency to an attenuation end frequency; and making the value of the frequency region signal zero in a frequency zone beyond the attenuation end frequency. Here, the attenuation frequency zone is a frequency interval defined by the attenuation start frequency and the attenuation end frequency and is set based on the code amount designated by the code amount designation unit.

The relation between the attenuation start frequency and the attenuation end frequency can be variously set according to the object. When the bandwidth-limiting unit is intended to attenuate frequency region signals in a high-frequency zone, the attenuation end frequency is set equal to the attenuation start frequency, or the attenuation end frequency is set higher than the attenuation start frequency. Setting the attenuation end frequency equal to the attenuation start frequency enables a stepped attenuation of the frequency region signals in the zone of higher frequencies than the attenuation start frequency. Alternatively, setting the attenuation end frequency higher than the attenuation start frequency enables a gradual attenuation of the frequency region signals in the zone of higher frequencies than the attenuation start frequency.

When the bandwidth-limiting unit attenuates a frequency region signal of a low-frequency region, the attenuation end frequency is set equal to the attenuation start frequency, or the attenuation end frequency is set lower than the attenuation start frequency. In this case, setting the attenuation end frequency equal to the attenuation start frequency enables a stepped attenuation of the frequency region signals in the zone of lower frequencies than the attenuation start frequency. Alternatively, setting the attenuation end frequency lower than the attenuation start frequency enables gradual attenuation of the frequency region signals in a region of lower frequencies than the attenuation start frequency.

The attenuation coefficients can be set to have a attenuation characteristic represented as a linear function which decreases linearly as the frequency varies in the attenuation frequency zone from the attenuation start frequency to the attenuation end frequency with an initial value set to 1.

Alternatively, the attenuation coefficients can be set to have a attenuation characteristic represented as a trigonometric function which decreases trigonometrically as the frequency varies in the attenuation frequency zone from the attenuation start frequency to the attenuation end frequency with an initial value set to 1.

The attenuation frequency zone is a frequency interval defined by the attenuation start frequency and the attenuation end frequency; the frequency zone can be a frequency interval defined by frequency 0 and the inverse of the product of ½ and the sampling period of audio signals; and the attenuation coefficients are 1 in a range of the frequency zone other than the attenuation frequency zone.

The bandwidth-limiting unit attenuates frequency region signals by multiplying the frequency region signal by an attenuation coefficient determined for each frequency in advance in accordance with a coding bit rate designated by the code amount designation unit. Signals of a frequency zone that is not the object of encoding can thus be eliminated to enable a smaller amount of operation and thus realize higher-quality audio signal encoding.

PREFERRED EMBODIMENTS OF THE INVENTION

We next refer to the accompanying figures to provide a detailed explanation of an embodiment of the present invention.

Figure 1:
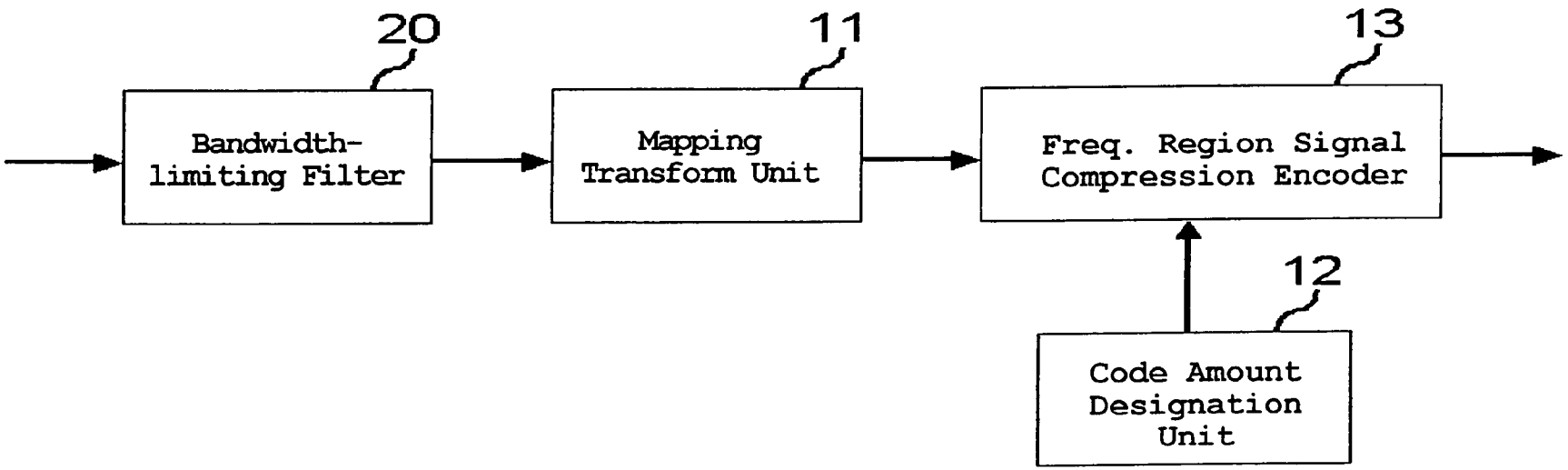
Fig. 1 PRIOR ART
FIG. 1 is a block diagram showing the construction of an audio signal encoder of the prior art.
Figure 2:
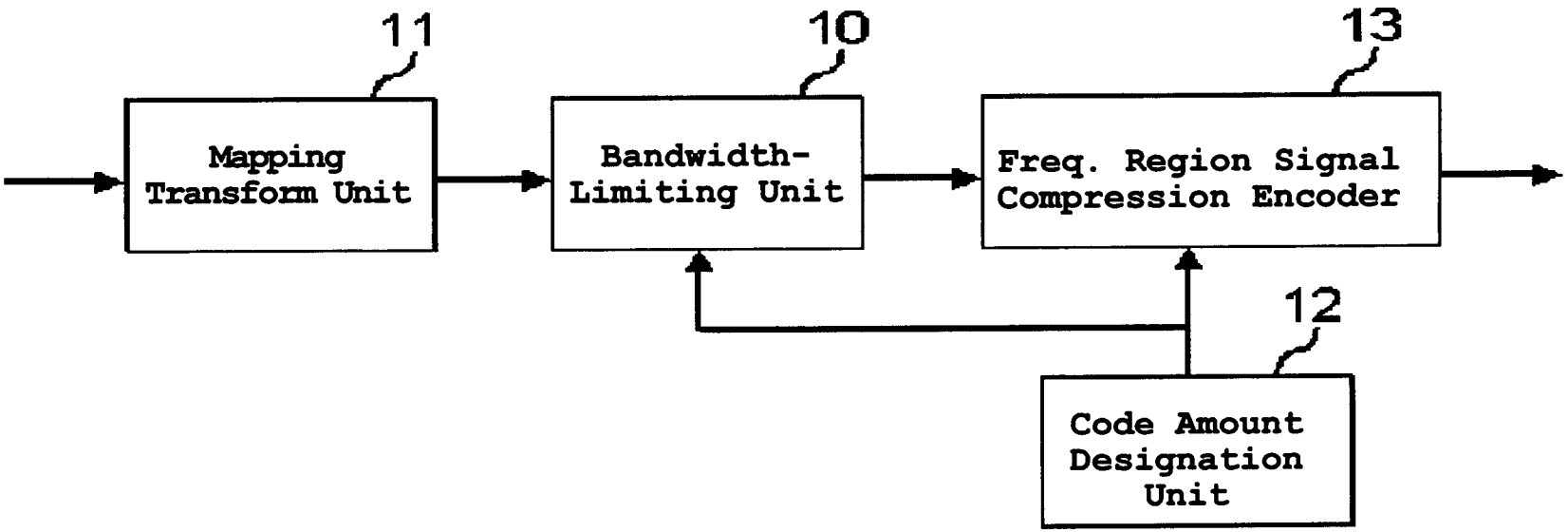
FIG. 2 is a block diagram showing the construction of an audio signal encoder of the present invention.

We first refer to FIG. 2, which is a block diagram showing the construction of an audio signal encoder of the present invention.

The audio signal encoder of the present embodiment includes mapping transform unit 11, bandwidth-limiting unit 10, code amount designation unit 12, and frequency region signal compression encoder 13.

Mapping transform unit 11 transforms input audio signals to frequency region signals. Bandwidth-limiting unit 10 attenuates a part of the frequency region signals. Frequency region signal compression encoder 13 compression-encodes the bandwidth-limited frequency region signals to generate a bitstream. Code amount designation unit 12 supplies a coding bit rate, which has been designated by a user, to both bandwidth-limiting unit 10 and frequency region signal compression encoder 13.

Explanation is next presented regarding the operation of the present embodiment.

Input audio signals are supplied to mapping transform unit 11. Mapping transform unit 11 effects a mapping transform on the input audio signals as in the prior art and generates frequency region signals. Explanation here involves a case in which a Modified Discrete Cosine Transform (MDCT) is employed as the mapping transform. In Reference 1, a single Modified Discrete Cosine Transform normally produces 256 MDCT coefficients. These MDCT coefficients express the spectrum intensity for each of the frequencies of the input audio signals. An arrangement of these MDCT coefficients in order starting from the lowest frequency can be expressed as:

$$\text{MDCT}(0), \text{MDCT}(1), \ldots, \text{MDCT}(255) \quad (1)$$

The detailed operation of mapping transform unit 11 is identical to that of the prior art, and since this operation has no relation to the characteristic part of the present invention, explanation of this operation is here omitted.

Code amount designation unit 12 supplies a coding bit rate designated by a user or a coding bit rate that has been determined in advance to bandwidth-limiting unit 10 and frequency region signal compression encoder 13. Except for the increase in the output destinations of the coding bit rate, the operation of code amount designation unit 12 is identical to that of the prior art.

Bandwidth-limiting unit 10, which is a characteristic part of the present invention, attenuates a number of MDCT coefficients of the received MDCT coefficients. The attenuation coefficients to be multiplied with the MDCT coefficients when attenuating are determined so as to provide the preset attenuation characteristic, based on the coding bit rate designated by code amount designation unit 12.

Explanation next regards the method of attenuating the high-frequency component.

According to Nyquist's sampling theorem, if the highest frequency included in a signal is $f_{MAX}$, then the original waveform can be reproduced by sampling at time intervals of $T \leqq 1/(2f_{MAX})$. Accordingly, provided that the Nyquist's sampling theorem is properly applied and that the sampling frequency of the input audio signal is $F_S$ Hertz, it follows that this audio signal has frequency components up to $(F_S/2)$. When this input audio signal is subjected to a mapping transform to generate the above-described 256 MDCT coefficients, the Ath frequency $f_A$ is approximately:

$$f_A=[(F_S/2)\div 256]\times A(\text{Hertz}) \quad (2)$$

Accordingly, the Ath MDCT coefficient MDCT(A) expresses the spectrum intensity for frequency $f_A$. In this case, the high-frequency component of the frequency equal to or higher than $f_A$ Hertz can be eliminated by putting the values of the Ath MDCT coefficient and succeeding MDCT coefficients (having the integer numbers equal to and more than A as numbered in the increasing order of the frequency) at 0. In the present invention, the value of $f_A$ is referred to as the attenuation start frequency.

This attenuation start frequency is set so as to attenuate the frequency zone that has been determined in advance in accordance with a compression rate (coding bit rate) designated by the user. Generally, it is required to narrow a bandwidth when a compression rate is high because a high compression rate causes it difficult to code a wideband signal with high-quality. The unnecessary zone is therefore preferably attenuated.

Although the foregoing explanation describes a case in which a high-frequency zone is selected as the unnecessary zone, this is an embodiment in which the correspondence between the coding bit rate and the attenuation start frequency is preferably determined in advance such that the attenuation start frequency lowers with increase in the compression rate designated by code amount designation unit 12.

Figure 3:
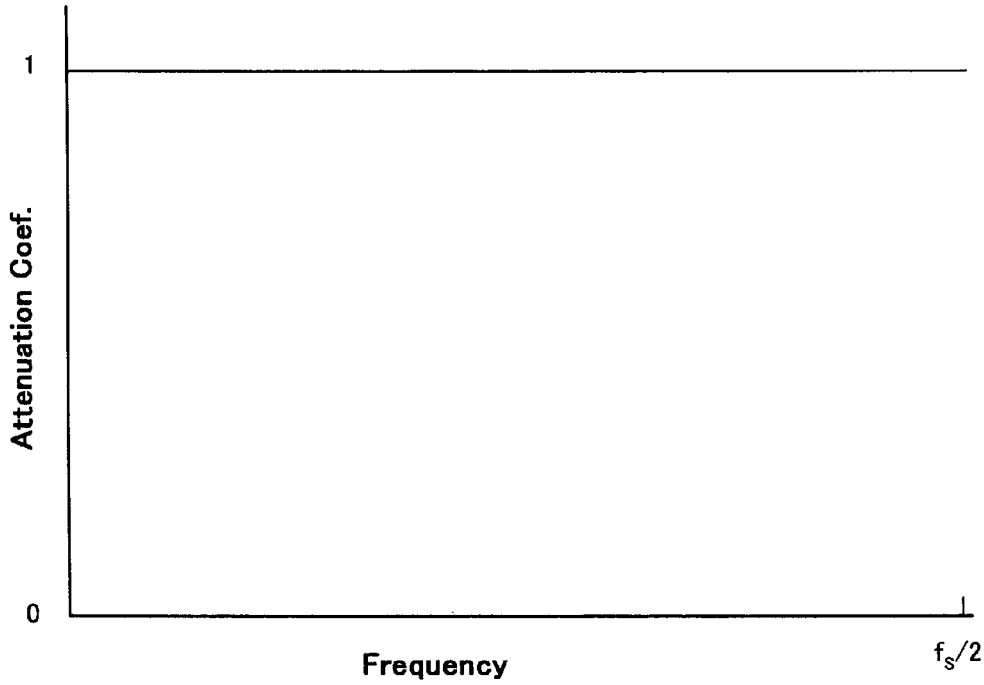
FIG. 3 shows an example of an attenuation coefficient for a case in which the bandwidth-limiting processing is not implemented.

FIG. 3 shows an example of attenuation coefficients for a case in which the bandwidth-limiting process is not applied. In this case, all MDCT coefficients supplied from mapping transform unit 11 are faithfully (without alteration) provided from bandwidth-limiting unit 10.

Figure 4:
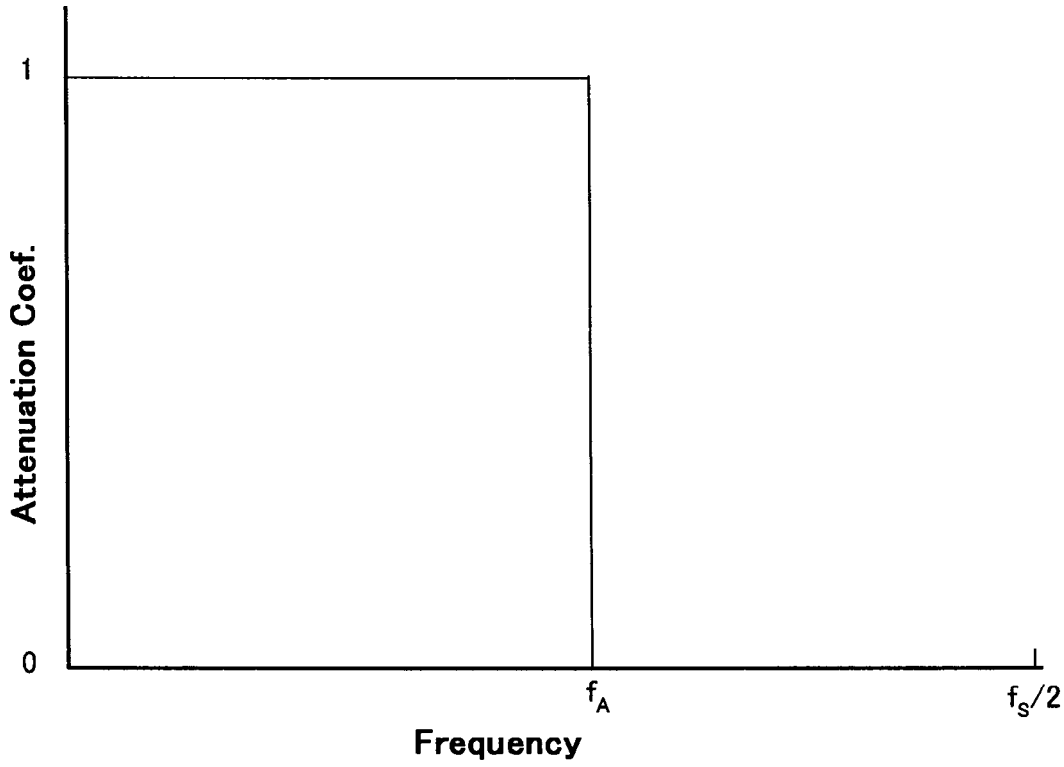
FIG. 4 shows the frequency characteristic of a first working example of an attenuation coefficient in which an MDCT coefficient in a high-frequency zone is subjected to a bandwidth-limiting processing.

FIG. 4 shows the frequency characteristic of the first working example of attenuation coefficients for attenuating MDCT coefficients in which a bandwidth-limiting process is applied to MDCT coefficients in a high-frequency zone. In the first working example, the attenuation coefficients plot a stepped curve. In FIG. 4, MDCT coefficients that are supplied from mapping transform unit 11 are faithfully provided as output from bandwidth-limiting unit 10 in the frequency zone lower than attenuation start frequency $f_A$. No output is provided by bandwidth-limiting unit 10 of MDCT coefficients in the frequency zone higher than attenuation start frequency $f_A$.

Figure 5:
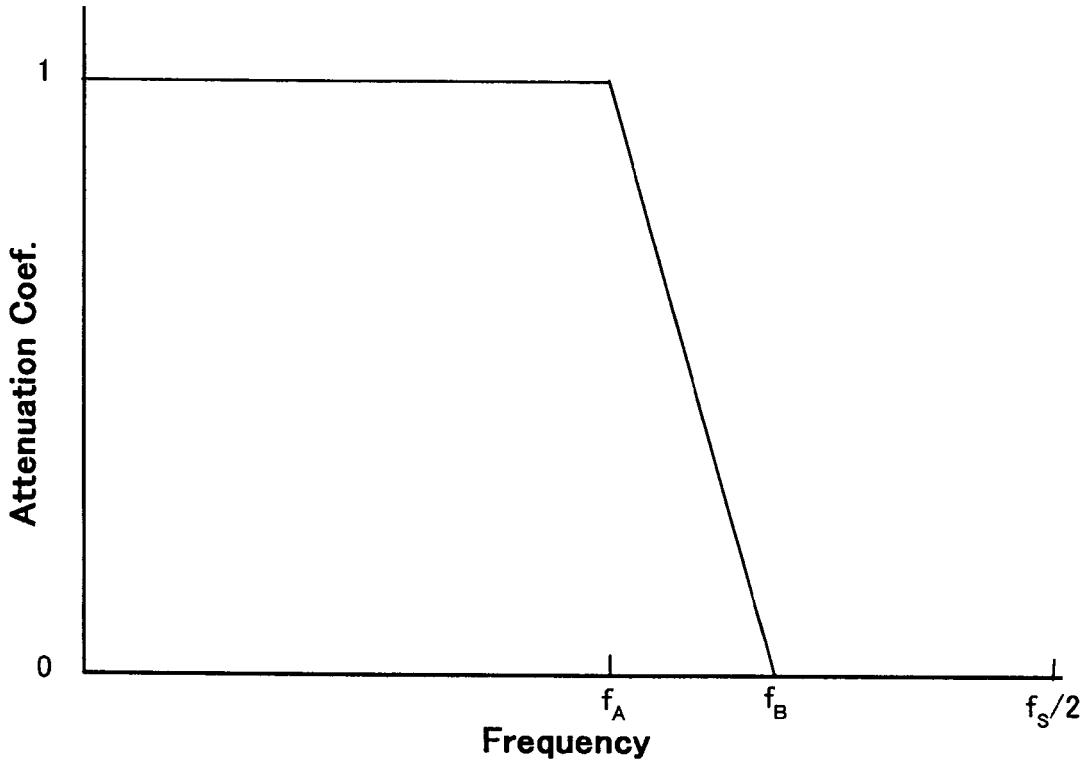
FIG. 5 shows the frequency characteristic of a second working example of an attenuation coefficient.

Explanation is next presented regarding the second working example of the present invention. FIG. 5 shows the frequency characteristic of the attenuation coefficients for the MDCT coefficients according to the present working example. This working example is a further advanced method for eliminating the high-frequency component of input audio signals. In the first working example, the high frequency component was eliminated by a stepped attenuation method in which the Ath MDCT coefficient MDCT(A) and succeeding MDCT coefficients were made zero. However, it has been confirmed that sound quality becomes slightly unnatural when this stepped attenuation is implemented. In this case, attenuation end frequency $f_B$ that expresses the frequency of the Bth MDCT coefficient, as well as attenuation start frequency $f_A$ that expresses the frequency of the Ath MDCT coefficient, is determined in advance in accordance with the coding bit rate. In this case, the values of B and $f_B$ are determined such that B>A, and consequently $f_B>f_A$. In addition, attenuation coefficients AT are determined such that the MDCT coefficients may gradually decrease from MDCT(A) to MDCT(B). In other words, for arbitrary F that satisfies $B \geqq F \geqq A$, MDCT(F) is multiplied by attenuation coefficient AT(F) of a predetermined attenuation characteristic. The attenuation coefficient AT(F) can be stored in bandwidth-limiting unit 10 in advance.

For frequency $f_F$, for example, the attenuation coefficient can be used which is represented as a linear function of frequency as follows:

$$AT(F)=1-k[(f_F-f_A)/(f_B-f_A)] \quad (3)$$

where $f_F$ stands for the Fth frequency that satisfies the expression $F \geqq A$. In expression (3), k is a proportionality constant and can be set arbitrarily.

As shown in FIG. 5, the attenuation coefficient curve of the MDCT coefficient attenuates as a linear function. FIG. 5 is for a case in which k=1. Since the attenuation coefficient is 1 in the frequency zone of frequencies 0-$f_A$, MDCT coefficients supplied from mapping transform unit 11 are faithfully provided as output by bandwidth-limiting unit 10. Since the attenuation coefficient attenuates linearly at higher frequency zone, the MDCT coefficients supplied from mapping transform unit 11 are multiplied by attenuation coefficients that each correspond to the respective frequencies by means of bandwidth-limiting unit 10, attenuated linearly with change in the frequency, and are then transmitted from bandwidth-limiting unit 10. No output is supplied from bandwidth-limiting unit 10 for frequencies higher than attenuation end frequency $f_B$.

Figure 6:
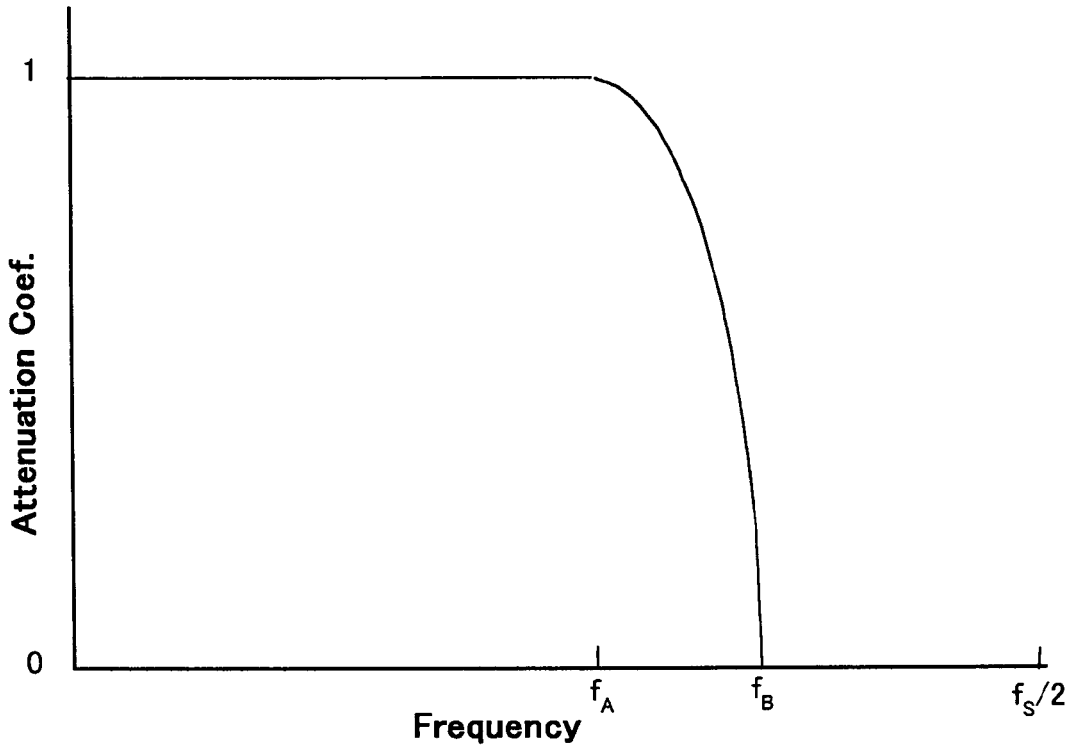
FIG. 6 shows the frequency characteristic of a third working example of an attenuation coefficient.

FIG. 6 shows the frequency characteristic of the third working example of the attenuation coefficient for the MDCT coefficient. The attenuation coefficient curve of the present working example attenuates as a trigonometric function. For frequency $f_F$, where $f_B \geqq f_F \geqq f_A$, the trigonometric function $$AT(F)=\cos[\{(fF-fA)/(fB-fA)\}(\pi/2)] \quad (4)$$

can be used. In addition, high-frequency components can be completely eliminated by making the Bth and succeeding MDCT coefficients zero.

Figure 7:
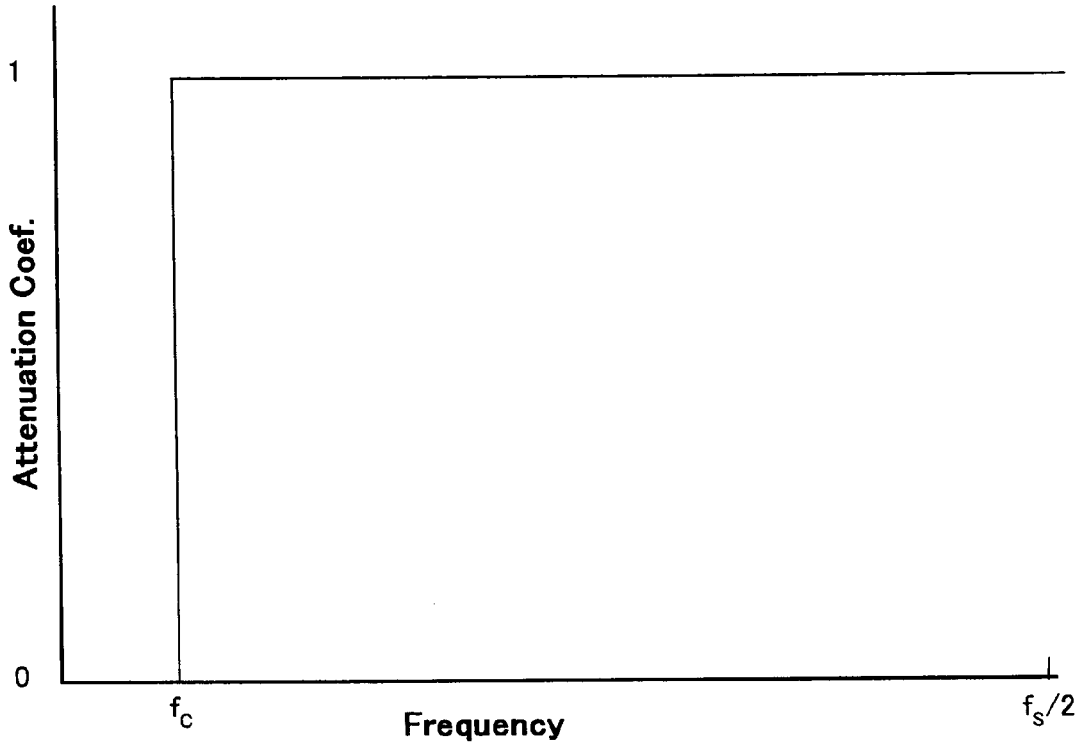
FIG. 7 shows the frequency characteristic of a fourth working example of an attenuation coefficient.

Explanation is next presented regarding a fourth working example of the present invention. The present example is intended to eliminate low frequency components FIG. 7 shows the frequency characteristic of the fourth working example of the attenuation coefficients of MDCT coefficients. In this working example, making the Cth and lower (frequencies lower than the Cth) MDCT coefficients zero in a stepped form enables the elimination of the frequency components of frequencies equal to or lower than frequency $f_C$ that corresponds to the Cth MDCT coefficient. In this working example, $f_C$ is the attenuation start frequency as well as the attenuation end frequency. In the zone of frequencies equal to and above attenuation start frequency $f_C$, where the attenuation coefficient is 1, the MDCT coefficients supplied from mapping transform unit 11 are faithfully provided as output by bandwidth-limiting unit 10 as previously described.

Figure 8:
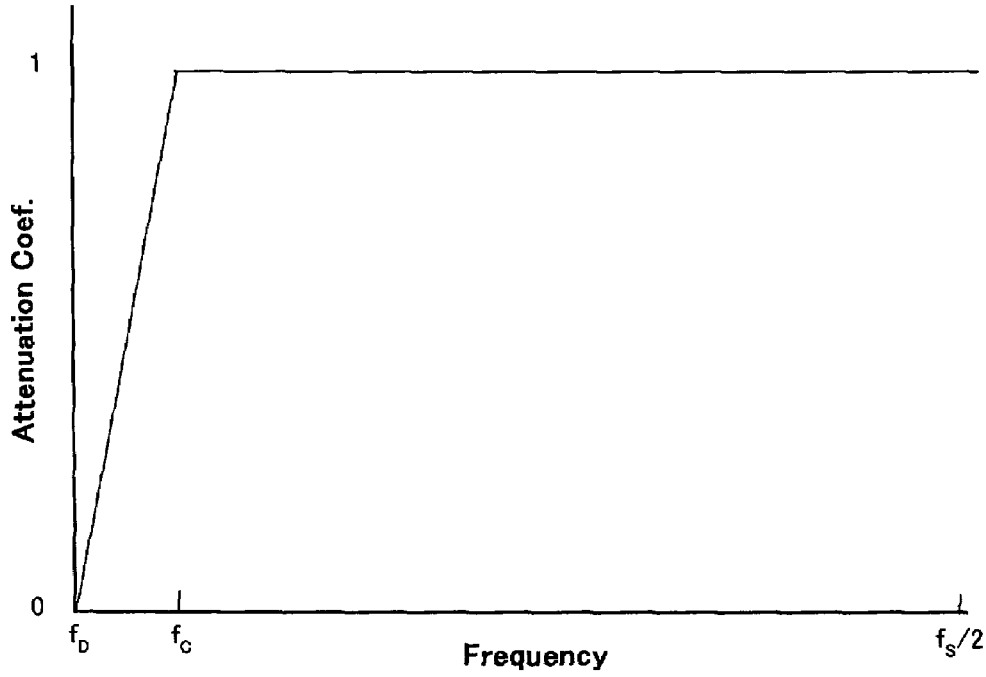
FIG. 8 shows the frequency characteristic of a fifth working example of an attenuation coefficient.

Explanation is next presented regarding a fifth working example of the present invention. FIG. 8 shows a frequency characteristic of the attenuation coefficients for MDCT coefficients according to the fifth working example.

Although this working example is a method of eliminating the low-frequency components, it offers a different approach from the fourth working example. While, in the fourth working example, the Cth and lower MDCT coefficients were made zero, in the fifth working example in contrast not only attenuation start frequency $f_C$, expressive of the frequency of the Cth MDCT coefficient, but also attenuation end frequency $f_D$ that corresponds to the Dth MDCT coefficient is determined in accordance with the coding bit rate. In this case, the value of D is D<C, and consequently, $f_C > f_D$. Generally, it is preferred that the values of D and $f_D$ are zero and that the attenuation coefficient AT is set so that the MDCT coefficient gradually decreases starting from MDCT(C) to MDCT(D). In other words, MDCT(F) for F, where $C \geqq F \geqq D$, is multiplied by an attenuation coefficient AT(F) of a predetermined attenuation characteristic. The attenuation coefficient AT(F) can be stored in advance in bandwidth-limiting unit 10. The attenuation coefficient used can be represented as a linear function of frequency in the frequency range $f_C \geqq f_F \geqq f_D$ corresponding to $C \geqq F \geqq D$, as represented below:

$$AT(F)=k[(f_F-f_D)/(f_C-f_D)]$$

Figure 9:
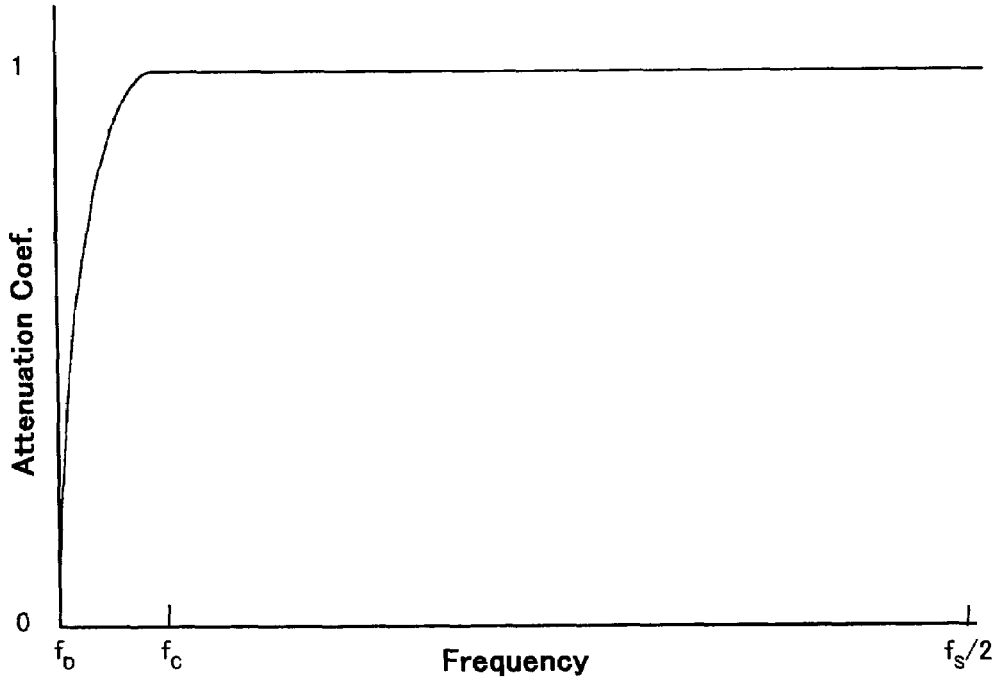
FIG. 9 shows the frequency characteristic of a sixth working example of an attenuation coefficient.

FIG. 9 shows the frequency characteristic of the attenuation coefficient of an MDCT coefficient according to a sixth working example, and shows the attenuation characteristic for subjecting the MDCT coefficient in the low-frequency zone to a trigonometric bandwidth-limiting processing.

In the present working example, the attenuation coefficient expressed by a trigonometric function of a frequency variable, as described below, can be employed wherein the frequency variable is in the same frequency range $f_C \geqq f_F \geqq f_D$ as that of the fifth working example.

$$AT(F)=\sin\ [\{(f_F-f_D)/(f_C-f_D)\}(\pi/2)] \quad (5)$$

In addition, making the Dth and lower-numbered (numbered lower than D) MDCT coefficients zero enables complete elimination of low frequency components. In FIG. 9, $f_D=0$ is set.

In the figure, MDCT coefficients supplied from mapping transform unit 11 are faithfully provided as output by bandwidth-limiting unit 10 for the frequency zone higher than $f_C$. In the frequency zone lower than attenuation start frequency $f_C$, MDCT coefficients produced by multiplying the output of mapping transform unit 11 by the attenuation coefficients are provided as output by bandwidth-limiting unit 10. No output is provided from bandwidth-limiting unit 10 for MDCT coefficients in the frequency zone lower than attenuation end frequency $f_D$ .

Frequency region signal compression encoder 13 subjects the MDCT coefficients that have been generated by bandwidth-limiting unit 10 to information compression to satisfy the coding bit rate designated by code amount designation unit 12, thereby generating a bitstream. Here, information compression includes entropy encoding of quantized values, suppression of signal redundancy among a plurality of channels, and quantization based on auditory characteristics widely used in audio encoding. These techniques are identical to techniques of the prior art such as Reference 1, are generally widely known, and further, have no relation to the novelty of the present invention, and detailed explanation of these techniques is therefore here omitted.

POTENTIAL FOR INDUSTRIAL APPLICATION

As described in the foregoing explanation, the present invention allows the spectrum component in the unnecessary frequency zone of an input audio signal to attenuate by multiplying the spectrum component of the unnecessary frequency zone by an attenuation coefficient so as to limit the bandwidth of the audio signal, whereby the present invention has the following merits:

1) A bandwidth-limiting filter is not required as in the prior art, and product-sum operations are therefore not required. The amount of operations required for limiting bandwidth is therefore reduced.

2) The present invention therefore not only enables an acceleration of operations and a reduction of power consumption, but also contributes to a simplification of circuits and device construction, contributes to an improvement in characteristics and performance, and further, contributes to higher integration.

What is claimed is:

1. An audio signal encoder comprising:

a mapping transform unit for subjecting input audio signals to a mapping transform and generating frequency region signals that take frequency as a variable;

a code amount designation unit for supplying as a code amount a coding bit rate that has been set or is designated by a user;

a frequency region signal compression encoder for performing a compression encoding processing on said frequency region signals based on the code amount designated by the code amount designation unit and generating a bitstream; and a bandwidth-limiting unit for:

executing bandwidth-limiting processing in accordance with attenuation characteristics that have been set corresponding to the code amount designated by said code amount designation unit, said bandwidth-limiting processing including steps of allocating a part of the frequency zone covered by said frequency region signals to an attenuation frequency zone, and multiplying the values of frequency region signals in said attenuation frequency zone by attenuation coefficients each having a value of 1 or less to attenuate said frequency region signals in said attenuation frequency zone; and supplying frequency region signals that have undergone said bandwidth-limiting processing to said frequency region signal compression encoder.

2. An audio signal encoder according to claim 1, wherein said bandwidth-limiting unit executes a bandwidth-limiting processing of:

attenuating said frequency region signal in an attenuation frequency zone by multiplying said frequency region signal by an attenuation coefficient defined so as to decrease as the frequency varies from an attenuation start frequency to an attenuation end frequency; and making the value of said frequency region signal zero in a frequency zone beyond said attenuation end frequency;

wherein said attenuation frequency zone is a frequency interval defined by the attenuation start frequency and the attenuation end frequency and is set based on the code amount designated by said code amount designation unit.

3. An audio signal encoder according to claim 2, wherein:

said attenuation end frequency is set equal to said attenuation start frequency or said attenuation end frequency is set higher than said attenuation start frequency, and said bandwidth-limiting unit attenuates frequency region signals in a frequency zone higher than said attenuation start frequency.

4. An audio signal encoder according to claim 3, wherein said attenuation coefficients have a attenuation characteristic represented as a linear function which decreases linearly as the frequency varies in said attenuation frequency zone from said attenuation start frequency to said attenuation end frequency with an initial value set to 1.

5. An audio signal encoder according to claim 4, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

6. An audio signal encoder according to claim 3, wherein said attenuation coefficients have a attenuation characteristic represented as a trigonometric function which decreases trigonometrically as the frequency varies in said attenuation frequency zone from said attenuation start frequency to said attenuation end frequency with an initial value set to 1.

7. An audio signal encoder according to claim 6, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

8. An audio signal encoder according to claim 3, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

9. An audio signal encoder according to claim 2, wherein:

said attenuation end frequency is set equal to said attenuation start frequency, or said attenuation end frequency is set lower than said attenuation start frequency; and said bandwidth-limiting unit attenuates frequency region signals in a frequency zone lower than said attenuation start frequency.

10. An audio signal encoder according to claim 9, wherein said attenuation coefficients have a attenuation characteristic represented as a linear function which decreases linearly as the frequency varies in said attenuation frequency zone from said attenuation start frequency to said attenuation end frequency with an initial value set to 1.

11. An audio signal encoder according to claim 10, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

12. An audio signal encoder according to claim 9, wherein said attenuation coefficients have a attenuation characteristic represented as a trigonometric function which decreases trigonometrically as the frequency varies in said attenuation frequency zone from said attenuation start frequency to said attenuation end frequency with an initial value set to 1.

13. An audio signal encoder according to claim 12, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

14. An audio signal encoder according to claim 9, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

15. An audio signal encoder according to claim 2, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

16. An audio signal encoder according to claim 1, wherein:

said attenuation frequency zone is a frequency interval defined by the attenuation start frequency and the attenuation end frequency;

said frequency zone is a frequency interval defined by frequency 0 and the inverse of the product of ½ and the sampling period of audio signals; and said attenuation coefficients are 1 in a range of said frequency zone other than said attenuation frequency zone.

17. A method of encoding an audio signal comprising the steps of:

mapping input audio signals and generating frequency region signals that take frequency as a variable;

designating a code amount and generating a coding bit rate based upon the code amount, said code amount is set internally or is designated by a user;

performing a compression encoding processing on said frequency region signals based on the code amount and generating a bitstream; and executing bandwidth-limiting processing in accordance with attenuation characteristics that have been set corresponding to the code amount, said bandwidth-limiting processing including substeps of:

allocating a part of the frequency zone covered by said frequency region signals to an attenuation frequency zone;

multiplying the values of frequency region signals in said attenuation frequency zone by attenuation coefficients each having a value of 1 or less to attenuate said frequency region signals in said attenuation frequency zone; and supplying frequency region signals that have undergone said bandwidth-limiting processing to a frequency region signal compression encoder.

18. A method of encoding an audio signal of claim 17, wherein said bandwidth-limiting processing further includes the substeps of:

attenuating said frequency region signals in an attenuation frequency zone by multiplying said frequency region signals by an attenuation coefficient defined so as to decrease as the frequency varies from an attenuation start frequency to an attenuation end frequency; and making the value of said frequency region signal zero in a frequency zone beyond said attenuation end frequency, wherein said attenuation frequency zone is a frequency interval defined by the attenuation start frequency and the attenuation end frequency and is set based on the code amount.

19. A method of encoding an audio signal of claim 18, wherein:

said attenuation end frequency is set equal to said attenuation start frequency or said attenuation end frequency is set higher than said attenuation start frequency, and frequency region signals in a frequency zone higher than said attenuation start frequency are attenuated.

20. A method of encoding an audio signal of claim 18, wherein:

said attenuation end frequency is set equal to said attenuation start frequency, or said attenuation end frequency is set lower than said attenuation start frequency; and frequency region signals in a frequency zone lower than said attenuation start frequency are attenuated.

* * * * *